US011282324B2

(12) United States Patent
Christl et al.

(10) Patent No.: US 11,282,324 B2
(45) Date of Patent: Mar. 22, 2022

(54) SYSTEM AND METHOD FOR PROCESSING AND PACKAGING DOCUMENTS OF VALUE, IN PARTICULAR BANKNOTES

(71) Applicant: GIESECKE+DEVRIENT CURRENCY TECHNOLOGY GMBH, Munich (DE)

(72) Inventors: Rudolf Christl, Munich (DE); Gerhard Hossle, Ebersberg (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 31 days.

(21) Appl. No.: 16/608,371

(22) PCT Filed: Apr. 25, 2018

(86) PCT No.: PCT/EP2018/000221
§ 371 (c)(1),
(2) Date: Oct. 25, 2019

(87) PCT Pub. No.: WO2018/197043
PCT Pub. Date: Nov. 1, 2018

(65) Prior Publication Data

US 2021/0074112 A1 Mar. 11, 2021

(30) Foreign Application Priority Data

Apr. 27, 2017 (DE) ..... 10 2017 004 064.8

(51) Int. Cl.
*G07D 11/16* (2019.01)
*G07D 11/50* (2019.01)
(Continued)

(52) U.S. Cl.
CPC ..... *G07D 11/16* (2019.01); *G07D 11/235* (2019.01); *G07D 11/40* (2019.01); *G07D 11/50* (2019.01)

(58) Field of Classification Search
CPC ..... G07D 11/50; G07D 11/16; G07D 11/235; G07D 11/40
See application file for complete search history.

(56) References Cited

U.S. PATENT DOCUMENTS 8,833,761 B2 * 9/2014 Dukart ..... G07D 11/237 271/258.01
2014/0069769 A1 * 3/2014 Kobayashi ..... G07D 11/00 194/206

(Continued)

FOREIGN PATENT DOCUMENTS

AT 505308 A4 * 12/2008 ..... G07D 11/50
AT 505308 A4 12/2008

OTHER PUBLICATIONS

International Search Report & Written Opinion from PCT Application No. PCT/EP2018/000221, dated Jul. 18, 2018.

*Primary Examiner* — Sonji N Johnson
(74) *Attorney, Agent, or Firm* — Workman Nydegger

(57) ABSTRACT

A system and a corresponding method for processing and packaging value documents having a processing apparatus, which is adapted to process, value documents, at least one bundling device, which is adapted to bundle processed value documents in packets and/or to bundle one or several packets. A packaging apparatus and a transport device adapted to feed one or several packets and/or bundles to the packaging apparatus. At least one storage device, which is adapted to receive one or several packets and/or bundles, and a control device, which is adapted to control the at least one storage device such that the one or several packets and/or bundles are temporarily stored in the storage device
(Continued)

for as long as the transport device and/or the packaging apparatus cannot receive any further packets and/or bundles.

16 Claims, 2 Drawing Sheets

(51) Int. Cl.
*G07D 11/40* (2019.01)
*G07D 11/235* (2019.01)

(56) References Cited

U.S. PATENT DOCUMENTS

2016/0217640 A1* 7/2016 Schmitz ..... G07D 11/12
2017/0076531 A1* 3/2017 Nada ..... G07D 11/30

* cited by examiner

SYSTEM AND METHOD FOR PROCESSING AND PACKAGING DOCUMENTS OF VALUE, IN PARTICULAR BANKNOTES

BACKGROUND

The invention relates to a system and a method for processing and packaging value documents, in particular banknotes, according to the independent claims.

In the automated processing of value documents, such as, for example, banknotes, these are checked in a processing apparatus with regard to various properties and sorted correspondingly. Apart from value documents which are fed directly to destruction, after the processing the value documents are usually first combined by means of bands to form packets, which are subsequently bundled into a bundle. The bundles are then fed to a packaging apparatus in which one or several bundles are packaged into a package unit.

If the packaging apparatus or a transport device which transports the bundles to the packaging apparatus can no longer receive further bundles, since its receiving capacity has been temporarily exhausted, the automatic processing, i. e. checking and/or sorting, of the value documents in the processing apparatus is usually stopped immediately to prevent uncontrolled jamming of the bundles in the packaging apparatus and/or on the transport device. However, this reduces the throughput of the value documents processed in the processing apparatus per unit of time.

SUMMARY

It is an object of the invention to state a system and a method for processing and packaging value documents, in which the highest possible throughput of the processed value documents is ensured.

The system according to the invention for processing and packaging value documents, in particular banknotes, has: a processing apparatus, which is adapted to process value documents, in particular to check, sort and/or destroy them, at least one bundling device, which is adapted to bundle processed value documents in packets and/or to bundle several packets, in which processed value documents have been bundled, in respectively one bundle, a packaging apparatus, which is adapted to package one or several packets and/or bundles, and a transport device, which is adapted to feed one or several packets and/or bundles to the packaging apparatus. Further, there is provided at least one storage device, which is adapted to receive one or several packets and/or bundles, and a control device, which is adapted to control the at least one storage device such that one or several packets and/or bundles can be temporarily stored in the storage device for as long as the transport device and/or the packaging apparatus cannot receive any further packets and/or bundles.

The method according to the invention for processing and packaging value documents, in particular banknotes, has the following steps of: processing, in particular checking, sorting and/or destroying value documents, bundling of processed value documents in packets and/or bundles of one or several packets, in which processed value documents have been bundled, in respectively one bundle, feeding the packages and/or bundles to a packaging apparatus by means of a transport device and packaging one or several packets and/or bundles in the packaging apparatus. One or several packets and/or bundles are temporarily stored in at least one storage device for as long as the transport device and/or the packaging apparatus cannot receive any further packets and/or bundles.

One aspect of the invention is based on the approach to temporarily store value paper packets and/or value paper bundles in which several value paper packets are combined at one or several locations in the processing apparatus when the packaging apparatus and/or a transport device transporting the packets and/or or bundles to the packaging apparatus can no longer receive any further packets and/or bundles. This makes it possible to continue the processing, in particular the checking, of further value documents and to temporarily store these at the relevant locations in the processing apparatus in the form of packets, packet stacks and/or bundles until the packaging apparatus and/or the transport device can again receive further bundles. Stopping the banknote processing in cases where the packaging apparatus and/or the transport device for transporting the bundles to the packaging apparatus can temporarily no longer receive further bundles is thereby not required, at least for a certain period of time, so that the throughput of the value documents processed in the processing apparatus is not affected. On the contrary, stopping the processing of the value documents is only necessary when the capacity for storing packets, packet stacks and/or bundles in the processing apparatus is exhausted.

Overall, this ensures that the throughput during processing of the value documents in the processing apparatus remains high despite temporary fluctuations in the receiving capacity of the packaging apparatus and/or transport device.

Preferably, there is provided at least one first bundling device, which is adapted to bundle processed value documents in packets, and at least one second bundling device, which is adapted to bundle one or several packets in respectively one bundle. Further, there is provided at least one first storage device, in particular a transfer hatch, which is adapted to receive at least one bundle, wherein the control device for controlling the first storage device is configured such that the bundle is temporarily stored in the first storage device for as long as the transport device and/or the packaging apparatus cannot receive any further bundle and/or the bundle is transferred to the transport device and/or the packaging apparatus when the transport device and/or the packaging apparatus can receive at least one further bundle. In this embodiment, the transfer hatch or a correspondingly configured transfer device, which can receive a bundle completed in the second bundling device and transfer it to the transport device and/or packaging apparatus, preferably serves as intermediate storage means for at least one bundle, if the receiving capacity of the transport device and/or packaging apparatus for further bundles is temporarily exhausted. The processing of further value documents in the processing apparatus is preferably continued or not stopped during the time in which the at least one bundle is stored in the first storage device, so that the throughput of the processing apparatus is not affected.

Further, there is preferably provided at least one second storage device, in particular in the form of a bundling position disposed in the region of the second bundling device, which is adapted to receive at least one bundle in which one or several packets stacked in a stack are bundled, wherein the control device for controlling the second storage device is configured such that the bundle is temporarily stored in the second storage device for as long as the first storage device, in particular the transfer hatch, cannot receive any further bundle, and/or the bundle is transferred to the first storage device when the first storage device can receive at least one further bundle. In this embodiment, the bundling position disposed in the second bundling device, in which the bundle is disposed after the bundling, preferably serves as intermediate storage means for the bundle, if the receiving capacity of the subsequent first storage device, in particular the transfer hatch, for further bundles is temporarily exhausted. In addition to the first storage device, in particular in the form of the transfer hatch, in this case the second bundling device is used as a further internal buffer storage means for at least one further bundle, so that the processing of further value documents in the processing apparatus can be continued for a correspondingly longer time, whereby the throughput of the processing apparatus correspondingly stays high for a longer time.

Preferably, the control device is configured to control the processing apparatus such that the processing, in particular checking and/or sorting, of further value documents is stopped only when the second storage device, in particular in the form of a bundling position in the second bundling device, cannot receive any further bundles. This ensures that the stations preceding the second bundling device and/or the second storage device cannot overflow through further processed value documents when bundling the value documents.

Preferably, there can be provided at least one third storage device, in particular a packet stacker, which is adapted to receive several packets stacked in a stack, wherein the control device for controlling the third storage device is configured such that the stack is temporarily stored in the third storage device for as long as the second bundling device and/or the second storage device cannot receive any further stack, and/or the stack is transferred to the second bundling device and/or to the second storage device when the second bundling device and/or the second storage device can receive at least one further stack. In this embodiment, preferably the packet stacker, in which banded packets are stacked until the stack has a predetermined number of packets and/or a predetermined height, is used as intermediate storage means for the packets for as long as the receiving capacity of the subsequent second bundling device and/or second storage device for a further stack or a further bundle is temporarily exhausted. In addition to the first storage device, in particular in the form of the transfer hatch, and the second bundling device and/or second storage device in this case the packet stacker is used as a further internal buffer storage means for at least one stack of packets which are not yet bundled in a bundle. The processing of further value documents in the processing apparatus can be continued correspondingly for a longer time, whereby the throughput of the processing apparatus correspondingly remains high for a longer time.

Preferably, the control device is further configured to control the processing apparatus such that the processing, in particular checking and/or sorting, of further value documents is only stopped when the third storage device can no longer receive any further packets and/or no further stacks. In addition, the control device can preferably be configured to control the processing apparatus such that the processing, in particular checking and/or sorting, of further value documents is stopped only when, furthermore, the first storage device and/or second storage device cannot receive any further bundles. This ensures that the internal buffer capacities of all three storage devices, i.e. preferably the transfer hatch, the second bundling device and the packet stacker, are exhausted before the processing of the value documents is stopped. As a result, the processing of further value documents in cases in which the transport device and/or the packaging apparatus temporarily cannot receive bundles is continued for a particularly long time, so that a particularly high throughput of the processing apparatus is ensured.

BRIEF DESCRIPTION OF THE DRAWINGS

Further advantages, features and application possibilities of the present invention will result from the following description in connection with the figures. There are shown.

DETAILED DESCRIPTION OF VARIOUS EMBODIMENTS

Figure 1:
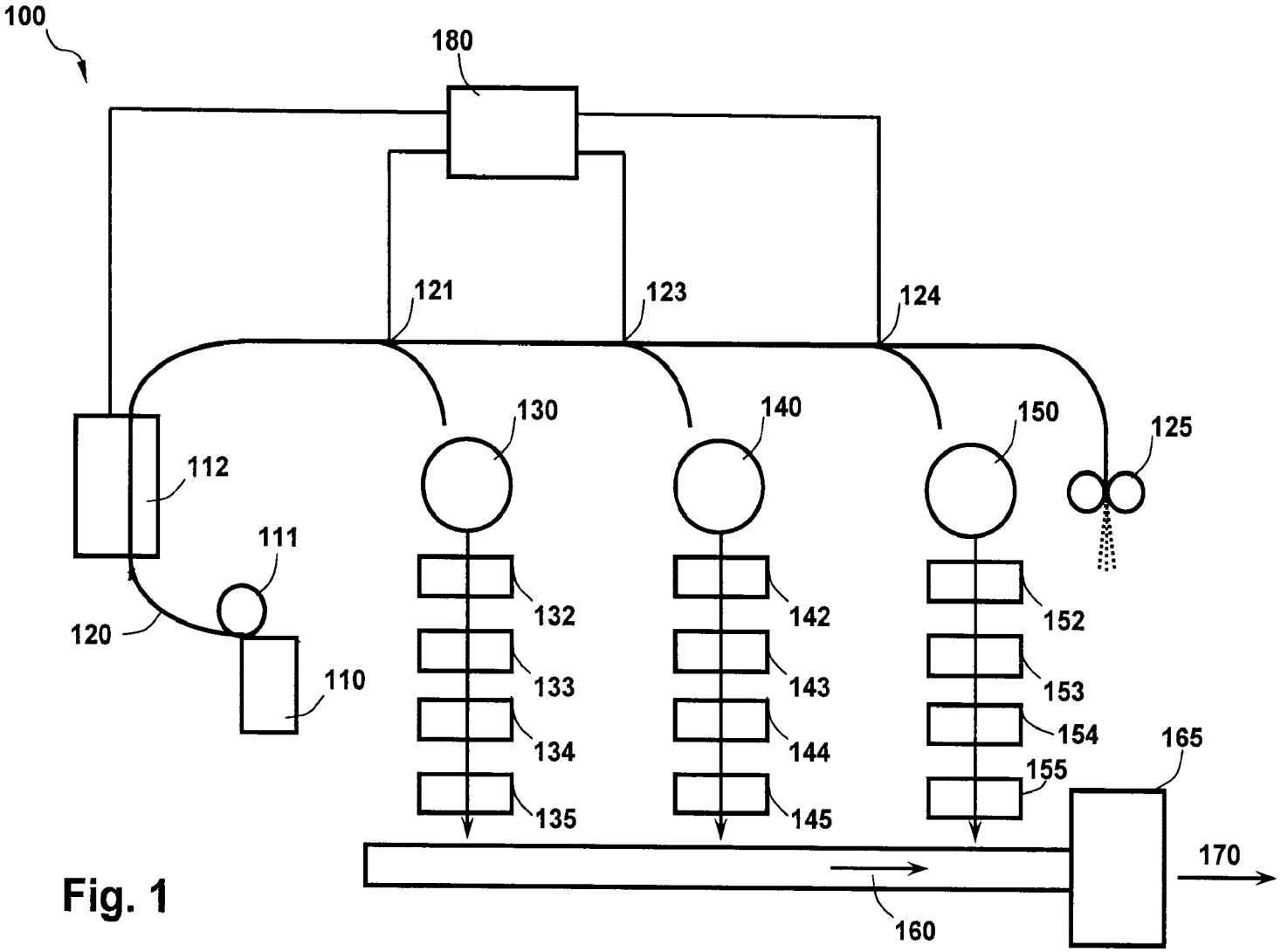
FIG. 1 an example of a system for processing and packaging value documents.

FIG. 1 shows an example of a system for processing and packaging value documents, in particular banknotes, with a banknote processing machine 100. The banknotes supplied in an input slot 110 are individually withdrawn from the input slot 110 by means of a singler 111 and transported past one or several sensors 112 along a transport path 120, wherein physical characteristics of the banknotes are detected and converted into corresponding sensor signals, which are considered in a control device 180 for detecting and/or checking, for example with regard to the authenticity and/or state of the banknotes.

Switches 121, 123 or 124 arranged along the transport path 120 are controlled by the control device 180 such that, in dependence on the result of the recognition and/or check, the banknotes are fed to different stackers 130, 140 or 150, which are preferably configured as so-called spiral slot stackers, or to a shredder 125 for destruction.

The banknotes output in the respective stacker 130, 140 or 150 are combined in a bander 132, 142 or 152, into one respective packet and are preferably bundled by means of a band. The banded packets are then fed to a packet stacker 133, 143 or 153 and stacked there into a stack of packets. When the respective stack contains a predetermined number of packets or reaches a predetermined stack height, it is fed to a bundler 134, 144 or 154, in which the packets disposed in the stack are combined into a bundle and, for example, welded into a foil.

A finished bundle is then fed to a transfer hatch 135, 145 or 155, which transfers the respective bundle to a transport device 160, by which the bundles are fed to a packaging apparatus 165 in which one or several bundles are combined and packaged in a package provided for this purpose. The packaging can be, for example, an already preformed container which is filled with the bundles and subsequently closed. Alternatively, it is also possible to pack the bundle or bundles in a flexible packaging material, for example by welding into a packaging foil. The packages obtained in this case with the bundles packed therein are then available for further employment or processing, such as a further transport and/or storage, which is indicated by the arrow 170.

When banknotes are always ready for processing in the input slot 110, packets are continuously produced, bundled into bundles and transferred to the transport device 160 by means of transfer hatches 135, 145 or 155. Depending on the application case, it can happen that the receiving capacity of the transport device 160 and/or of the packaging apparatus 165 is temporarily exhausted, so that said device and/or apparatus can no longer receive further bundles. In order for the processing of further banknotes in the banknote processing machine 100 not to have to be stopped immediately in such cases, one or several bundles and/or packets are temporarily stored in the banknote processing machine 100, without transferring a bundle to the transport device 160 and/or the packaging apparatus 165. When the transport device 160 and/or the packaging apparatus 165 can then again receive bundles and transport and/or package them, the stored packets or bundles are transferred to the respectively subsequent station, i.e. to the bundler 134, 144 or 154, to the transfer hatch 135, 145 or 155 and/or to the transport device 160.

As storage devices, there are preferably provided the packet stacker 133, 143 or 153 and/or the bundler 134, 144 or 154 and/or the transfer hatch 135, 145 or 155, which individually or together form an internal buffer for the storage of already processed value documents. The processing of further banknotes in the banknote processing machine 100 therefore preferably has to be stopped only when the receiving capacity of these internal buffers, i.e. of the packet stacker and/or bundler and/or of the transfer hatch, is exhausted. In cases in which the transport device 160 and/or the packaging apparatus 165 can temporarily no longer receive bundles, the throughput of the banknote processing machine is not reduced in this manner.

Depending on the application case and the configuration of the system, the transfer hatch 135, 145 or 155, the bundler 134, 144 or 154 and/or the packet stacker 133, 143 or 153 is preferably controlled by the control device 180 as follows:

a) When a bundle is disposed in the transfer hatch 135, 145 or 155, said bundle is ejected and transferred to the transport device 160 only when the transport device 160 can receive further bundles. If, on the other hand, the transport device 160 can no longer receive any further bundles, the bundle is initially stored in the transfer hatch 135, 145 or 155 without the banknote processing machine 100 being stopped. When the transport device 160 can receive further bundles again, the bundle stored in the transfer hatch 135, 145 or 155 is ejected and transferred to the transport device 160.

b) When, after bundling, for example by welding it into a foil, a finished bundle is disposed in a bundling position in the bundler 134, 144 or 154, the bundle is forwarded to the transfer hatch 135, 145 or 155 only when the transfer hatch 135, 145 or 155 can receive new bundles. When the transfer hatch 135, 145 or 155 is already occupied by one or several bundles, the bundle remains in the bundling position in the bundler 134, 144 or 154 until the transfer hatch 135, 145 or 155 can again receive one or several bundles. In this case, it can preferably be provided that the processing of further value documents in the banknote processing machine 100 is stopped when the transfer hatch 135, 145 or 155 is occupied and a bundle is stored in the bundling position of the bundler 134, 144 or 154.

c) When several banded packets are disposed in the packet stacker 133, 143 or 153, the processing of further value documents in the banknote processing machine 100 is continued and stopped only when a predetermined number of packets is disposed in the packet stacker 133, 143 or 153 for a subsequent bundling process and respectively at least one bundle is already disposed both in the bundler 134, 144 or 154 and in the transfer hatch 135, 145 or 155.

Thus, while in the application case a) the transfer hatch 135, 145 or 155 is used as intermediate storage means for one or several bundles, in the application case b) both the transfer hatch 135, 145 or 155 and the bundler 134, 144 or 154 are used as intermediate storage means. Finally, in the application case c), in addition to the transfer hatch 135, 145 or 155 and the bundler 134, 144 or 154, also the packet stacker 133, 143 or 153 is used as intermediate storage means. Depending on the number and size of the utilized intermediate storage means, a possibly required stopping of the processing process in the banknote processing machine 100 can be delayed for a correspondingly longer time.

Figure 2:
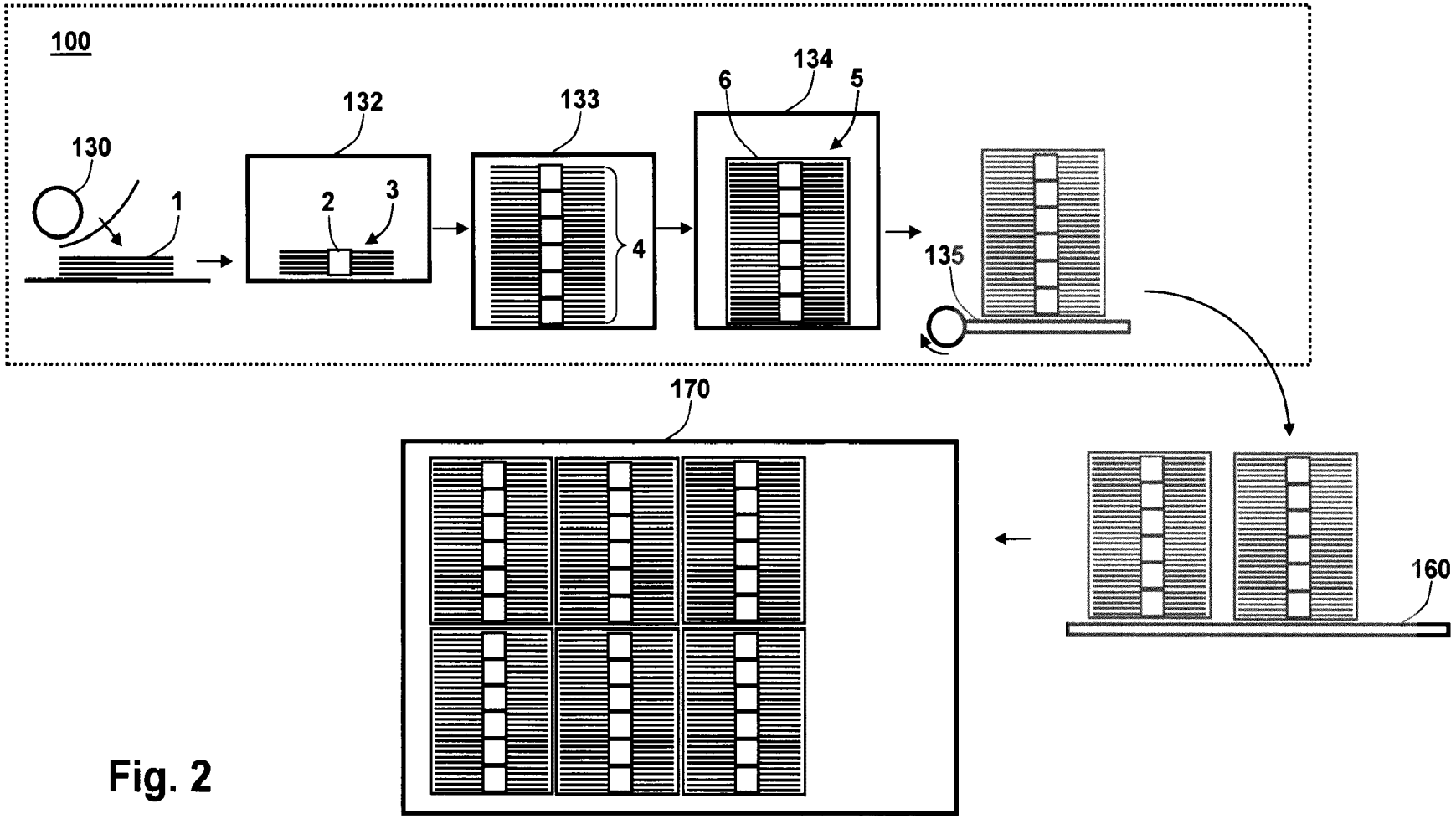
FIG. 2 an example for illustrating a sequence in the bundling and packaging of value documents.

FIG. 2 shows an example of a sequence in the bundling and packaging of value documents. The banknotes 1 successively output at a stacker 130 of the banknote processing machine 100 are initially loosely stacked and then fed to a bander 132, in which they are bundled to form a packet 3 in each case, for example by means of a band 2.

The packets 3 are then fed to a packet stacker 133 and stacked there until the obtained stack 4 contains a predetermined number of packets 3 and/or reaches a predetermined height. When the stack 4 has reached the predetermined height or number of packets, said stack is transferred to a bundler 134 and welded there into a packaging foil 6 or wrapped by a packaging tape, wherein a bundle 5 is obtained.

The bundle 5 with the packets 3 contained therein is then fed to a transfer hatch 135, which transfers the bundle 5 to a transport device 160, which conveys said bundle to a packaging device 165, in which several, in particular a predetermined number, of bundles 5 are combined and packaged.

As indicated in FIG. 2 by dotted lines, the stacker 130, the bander 132, the packet stacker 133, the bundler 134 and the transfer hatch 135 are preferably components of the banknote processing machine 100 (see also FIG. 1), to which the transport device 160 and the packaging apparatus 165 are connected downstream.

As already explained above in connection with the example shown in FIG. 1, the transfer hatch 135 and/or the bundler 134 and/or the packet stacker 133 are each used as an internal buffer of the banknote processing machine 100 in order to temporarily store one or several bundles 5 or packets 3 in the banknote processing machine 100 when the transport device 160 and/or the packaging apparatus 165 temporarily can no longer receive any further bundles 5. The above statements in connection with FIG. 1 apply correspondingly to the example shown in FIG. 2.

The invention claimed is:

1. A system for processing and packaging value documents, the system comprising:

a processing apparatus that processes value documents, at least one bundling device that bundles processed value documents into packets and/or bundles one or several packets in which processed value documents have been bundled into one respective bundle, a packaging apparatus that packages one or several packets and/or bundles, a transport device that feeds the packets and/or bundles to the packaging apparatus, at least one storage device that receives one or several of the packets and/or bundles, and a control device that controls the at least one storage device such that the packet or packets and/or bundles are temporarily stored in the storage device for as long as the transport device and/or the packaging apparatus cannot receive any further packets and/or bundles, wherein the at least one bunding device includes a first bundling device that bundles processed value documents into packets and a second bundling device that bundles one or several of said packets into one respective bundle, wherein the at least one storage device includes a first storage device that receives said bundle, wherein the control device is configured such that the bundle is temporarily stored in the first storage device for as long as the transport device and/or the packaging apparatus cannot receive any further bundle, or the bundle is transferred to the transport device and/or the packaging apparatus when the transport device and/or the packaging apparatus can receive at least one further bundle wherein the system further comprises at least one second storage device which is adapted to receive at least one bundle in which one or several packets stacked in a stack have been bundled, wherein the control device for controlling the second storage device is configured such that the bundle is temporarily stored in the second storage device for as long as the first storage device cannot receive any further bundle and/or the bundle is transferred to the first storage device when the first storage device can receive at least one further bundle, wherein the control device is further configured to control the processing apparatus such that the processing of further value documents is stopped only when the second storage device cannot receive any further bundles.

2. The system according to claim 1, having at least one third storage device which is adapted to receive one or several packets stacked in a stack, wherein the control device for controlling the third storage device is configured such that the stack is temporarily stored in the third storage device for as long as the second bundling device and/or the second storage device cannot receive any further stack, and/or the stack is transferred to the second bundling device and/or to the second storage device when the second bundling device and/or the second storage device can receive at least one further stack.

3. The system according to claim 2, wherein the control device is further configured to control the processing apparatus such that the processing of further value documents is stopped only when third storage device can no longer receive any further packets and/or no further stack.

4. The system according to claim 3, wherein the control device is further configured to control the processing apparatus such that the processing of further value documents is only stopped when, furthermore, the first storage device and/or second storage device cannot receive any further bundles.

5. The system according to claim 1, wherein the control device is configured such that the bundle is temporarily stored in the first storage device for as long as the transport device and/or the packaging apparatus cannot receive any further bundle.

6. The system according to claim 1, wherein the control device is configured such that the bundle is transferred to the transport device and/or the packaging apparatus when the transport device and/or the packaging apparatus can receive at least one further bundle.

7. A method for processing and packaging value documents having the following steps of:

processing value documents;

bundling processed value documents into packets and/or bundling one or several packets in which processed value documents have been bundled into respectively one bundle;

feeding the packets and/or bundles to a packaging apparatus by a transport device and packaging several of the packets and/or bundles in the packaging apparatus;

wherein the step of bundling is performed by a first bundling device that bundles processed value documents into packets and a second bundling device that bundles one or several of said packets into one respective bundle;

receiving, by a first storage device, said bundle; and storing one or several of the packets and/or bundles temporarily in the first storage device for as long as the transport device and/or the packaging apparatus cannot receive any further packets and/or bundles, wherein the packets and/or bundles are temporarily stored in the first storage device for as long as the transport device and/or the packaging apparatus cannot receive any further bundle, or the bundle is transferred to the transport device and/or the packaging apparatus when the transport device and/or the packaging apparatus can receive at least one further bundle;

wherein the method further comprises receiving, by a second storage device, at least one bundle in which one or several packets stacked in a stack have been bundled;

storing the at least one bundle temporarily in the second storage device such that the bundle is temporarily stored in the second storage device for as long as the first storage device cannot receive any further bundle and/or the bundle is transferred to the first storage device when the first storage device can receive at least one further bundle; and controlling the processing apparatus such that the processing of further value documents is stopped only when the second storage device cannot receive any further bundles.

8. The method according to claim 7, further comprising receiving, by a third storage device, one or several packets stacked in a stack, storing the at least one bundle temporarily in the third storage device such that the stack is temporarily stored in the third storage device for as long as the second bundling device and/or the second storage device cannot receive any further stack, and/or the stack is transferred to the second bundling device and/or to the second storage device when the second bundling device and/or the second storage device can receive at least one further stack.

9. The method according to claim 8, further comprising controlling the processing apparatus such that the processing of further value documents is stopped only when the third storage device can no longer receive any further packets and/or no further stack.

10. The method according to claim 9, further comprising controlling the processing apparatus such that the processing of further value documents is only stopped when, furthermore, the first storage device and/or second storage device cannot receive any further bundles.

11. The method according to claim 7, wherein the packets and/or bundles are temporarily stored in the first storage device for as long as the transport device and/or the packaging apparatus cannot receive any further bundle.

12. The method according to claim 7, wherein the bundle is transferred to the transport device and/or the packaging apparatus when the transport device and/or the packaging apparatus can receive at least one further bundle.

13. A system for processing and packaging value documents, the system comprising:

a processing apparatus that processes value documents;

a packeting device that receives processed value documents and forms the processed value documents into packets;

a bundling device that receives the packets and bundles the packets into bundles containing one or more of the received packets;

a packaging apparatus that packages the bundles with a packaging, a transport device that transports the bundles to the packaging apparatus, and a plurality of storage devices including a first storage device and a second storage device, which individually or together form an internal buffer that temporarily store the packets or the bundles for as long as the transport device or the packaging apparatus cannot receive any further packets or bundles, wherein the plurality of storage devices further includes a third storage device that individually or together with the first storage device and the second storage device forms an internal buffer that temporarily stores the packets or the bundles for as long as the transport device or the packaging apparatus cannot receive any further packets or bundles.

14. The system according to claim 13, wherein the first storage device is provided in a packet stacker device wherein packets are received and stacked.

15. The system according to claim 13, wherein the second storage device is provided in the bundling device.

16. The system according to claim 13, wherein the third storage device is provided in transfer hatch that receives the bundles and transfers the bundles to the transport device.

* * * * *